US012385227B2

(12) United States Patent
Wei

(10) Patent No.: US 12,385,227 B2
(45) Date of Patent: Aug. 12, 2025

(54) SYSTEM AND METHOD FOR MONITORING WORK AREA

(71) Applicant: Caterpillar Inc., Peoria, IL (US)

(72) Inventor: Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 159 days.

(21) Appl. No.: 18/155,915

(22) Filed: Jan. 18, 2023

(65) Prior Publication Data

US 2024/0240435 A1 Jul. 18, 2024

(51) Int. Cl.
*E02F 9/26* (2006.01)
*E02F 9/24* (2006.01)

(52) U.S. Cl.
CPC ..... *E02F 9/261* (2013.01); *E02F 9/24* (2013.01)

(58) Field of Classification Search
CPC ..... E02F 9/261; E02F 9/24; E02F 9/205
See application file for complete search history.

(56) References Cited

U.S. PATENT DOCUMENTS

| | | | |
|---|---|---|---|
| 9,041,589 | B2 | 5/2015 | Chang et al. |
| 9,869,555 | B2 | 1/2018 | Sakai et al. |
| 11,126,188 | B2 | 9/2021 | Spielman et al. |
| 2020/0041649 | A1 | 2/2020 | Green et al. |
| 2021/0002852 | A1 | 1/2021 | Nishi |
| 2021/0271248 | A1 | 9/2021 | Stander et al. |
| 2022/0170242 | A1* | 6/2022 | Maley ..... G06T 7/70 |

FOREIGN PATENT DOCUMENTS

| | | |
|---|---|---|
| WO | 2021108838 | 6/2021 |
| WO | 202237507 | 2/2022 |

* cited by examiner

*Primary Examiner* — Brian P Sweeney

(57) ABSTRACT

A system for monitoring a work area of a work machine includes a sensor system. The sensor system generates one or more input signals corresponding to a position of at least one object present in at least one of the work area and a predetermined area. The input signals are indicative of the position of the object at different instances of time. The system also includes a controller communicably coupled to the sensor system. The controller includes one or more memories and one or more processors. The one or more processors receive the one or more input signals, determine a moving route of the object based on the receipt of the one or more input signals, and generate a response signal if a start point of the object is located in the predetermined area and an end point of the object is located at the work area.

19 Claims, 3 Drawing Sheets

SYSTEM AND METHOD FOR MONITORING WORK AREA

TECHNICAL FIELD

The present disclosure relates to a system and a method for monitoring a work area of a work machine.

BACKGROUND

A work machine, such as, an excavator is often used to perform a variety of tasks at a worksite. For example, one or more work machines may be used to remove a layer of gravel, concrete, asphalt, soil, or other material at a work area of the worksite.

During a work operation, such as digging, one or more objects may slip or enter into the work area. For example, the one or more objects may include a safety cone, one or more tools, and the like. It is imperative to determine if the object is from within the work area or if the object is a foreign object which may have moved into the work area. If the object is from within the work area, the work operation may be continued. However, if the object has entered into the work area, the work operation may have to be paused in order to remove the object from the work area.

Typically, a classification algorithm is used to identify if one or more objects have entered the work area. However, the classification algorithm may lack accuracy in identification of the objects, and may not be reliable. Further, the classification algorithm typically requires large amounts of computational power to classify/identify the objects at the work area. Moreover, classifying objects using the classification algorithm may require picky sampling techniques which may be costly and may have low performance. Thus, such a classification algorithm may not be practical and cost effective.

In some cases, a supervisor may have to continuously monitor the work area to check any possible entrance of the objects into the work area, which may not be feasible as such a technique may subject supervisors to harsh operating environments at the worksite and may also increase human interference.

U.S. Pat. No. 11,126,188 describes a method for maintaining a work surface at a worksite. The method includes receiving a worksite plan to be executed by a machine at a worksite and determining first travel parameters of the machine. Such first travel parameters include a first travel path along a work surface, and first work tool positions. The method also includes controlling the machine to traverse at least part of the first travel path, receiving sensor information associated with the work surface, and identifying an imperfection of the work surface located along the first travel path. The method further includes determining second travel parameters of the machine. Such second travel parameters including a second travel path along the work surface, and second work tool positions. The method also includes controlling the machine to traverse at least part of the second travel path while positioning the work tool according to at least one of the second work tool positions.

SUMMARY OF THE DISCLOSURE

In an aspect of the present disclosure, a system for monitoring a work area of a work machine is provided. The system includes a sensor system configured to generate a plurality of input signals corresponding to a position of at least one object present in at least one of the work area and a predetermined area surrounding the work area. The plurality of input signals are indicative of the position of the object at different instances of time. The system also includes a controller communicably coupled to the sensor system. The controller includes one or more memories and one or more processors communicably coupled with the one or more memories. The one or more processors are configured to receive the plurality of input signals indicative of the position of the object at different instances of time. The one or more processors are also configured to determine a moving route of the object based on the receipt of the plurality of input signals. The moving route includes a start point and an end point. The one or more processors are further configured to generate a response signal if the start point of the object is located in the predetermined area and the end point of the object is located at the work area.

In another aspect of the present disclosure, a method for monitoring a work area of a work machine is provided. The method includes generating, by a sensor system, a plurality of input signals corresponding to a position of at least one object present in at least one of the work area and a predetermined area surrounding the work area. The plurality of input signals are indicative of the position of the object at different instances of time. The method also includes receiving, by a controller, the plurality of input signals indicative of the position of the object at different instances of time. The method further includes determining, by the controller, a moving route of the object based on the receipt of the plurality of input signals. The moving route includes a start point and an end point. The method includes generating, by the controller, a response signal if the start point of the object is located in the predetermined area and the end point of the object is located at the work area.

Other features and aspects of this disclosure will be apparent from the following description and the accompanying drawings.

DETAILED DESCRIPTION

Wherever possible, the same reference numbers will be used throughout the drawings to refer to the same or like parts.

Figure 1:
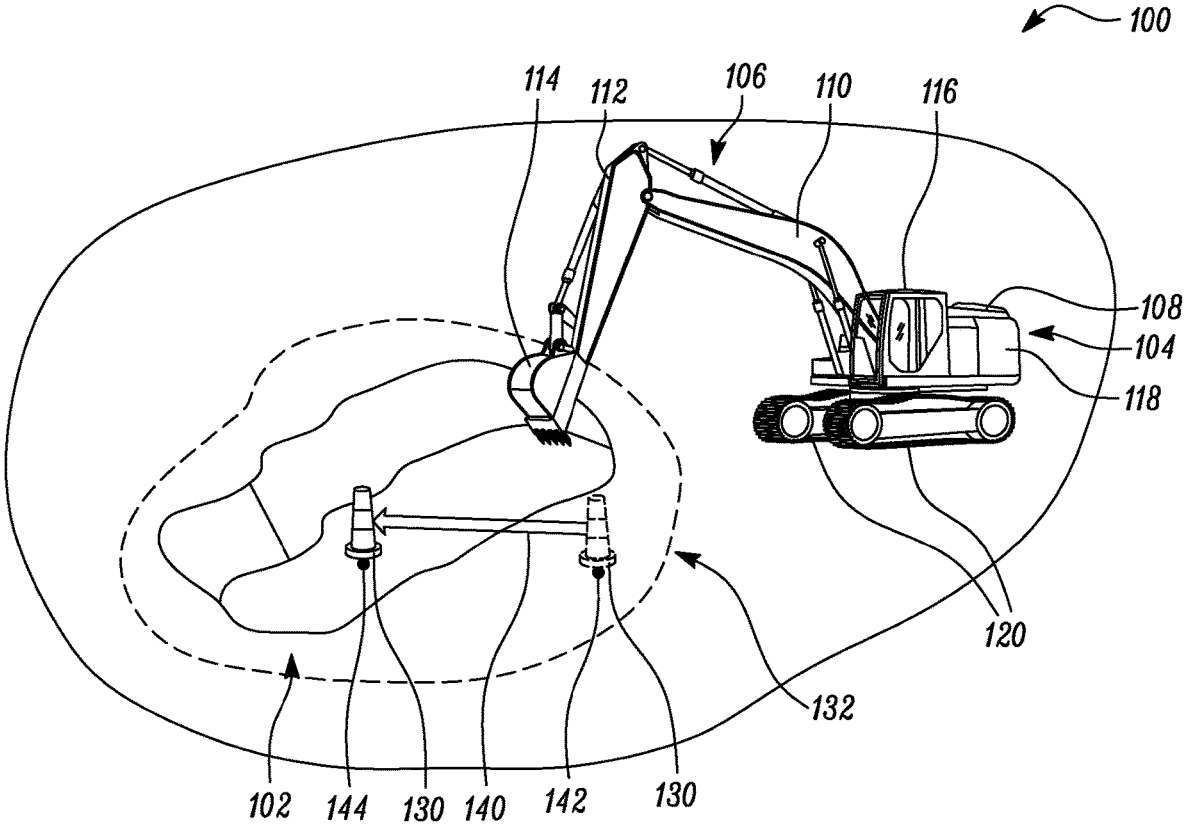
FIG. 1 is a schematic diagram illustrating a portion of a worksite including a work area and a work machine, according to an embodiment of the present disclosure.

Referring to FIG. 1, a schematic view of a portion of a worksite 100 including a work machine 104 is illustrated. The worksite 100 includes a work area 102 and a predetermined area 132 surrounding the work area 102. The predetermined area 132 is a virtual boundary defined around the work area 102. The predetermined area 132 may be larger than the work area 102. The work machine 104 may perform various earthmoving operations, for example a digging operation, at the work area 102.

The work machine 104 is embodied as a hydraulic excavator that may be used for purposes, such as, digging, construction, landscaping, and the like. Alternatively, the work machine 104 may be embodied as an off-highway truck, a dozer, a wheel loader, a track-type tractor, a motor grader, and the like, that may be used in various industries to move, remove, or load materials, such as, asphalt, debris, dirt, snow, feed, gravel, logs, raw minerals, recycled material, rock, sand, and/or woodchips. In the illustrated example of FIG. 1, the work machine 104 is shown as performing the digging operation at the work area 102. In the illustrated example of FIG. 1, the work machine 104 is embodied as an autonomous work machine. Alternatively, the work machine 104 may embody a semi-autonomous work machine or a manual work machine.

The work machine 104 includes a front work unit 106. The work machine 104 also includes a body 108. The front work unit 106 is movably coupled to the body 108. The front work unit 106 includes a boom 110 and an arm 112. The front work unit 106 also includes a work tool 114 pivotally coupled to the arm 112. The work tool 114 may be used to perform work operations, such as, loading, stock piling, dumping, digging, and the like. The work tool 114 is embodied as a bucket herein. Alternatively, the work tool 114 may include any other type of work tool known in the art, such as, a blade.

The body 108 includes an operator cabin 116. The operator cabin 116 may include one or more controls (not shown) that may enable an operator to control the work machine 104. The body 108 also includes a hood 118. Further, the work machine 104 includes a power source (not shown) disposed within the hood 118. The power source may include an engine, such as, an internal combustion engine, batteries, motors, and the like. The power source may provide power to various components of the work machine 104 for operational and mobility requirements. The work machine 104 includes a pair of tracks 120. The pair of tracks 120 provide support and mobility to the work machine 104 on grounds. Alternatively, the work machine 104 may include wheels instead of the tracks 120.

Further, one or more objects, such as, an object 130 may be present at the worksite 100. In some examples, the object 130 may be present at the work area 102 before a commencement of the digging operation. However, in other examples, as shown in FIG. 1, the object 130 may be present in the predetermined area 132, and may move into the work area 102, for example, due to operations being performed at the worksite 100. In the illustrated example of FIG. 1, the single object 130 i.e., a safety cone is shown at the worksite 100. However, a number of objects, such as, helmets, tools, basketballs, and the like may be present at the work area 102 and/or the predetermined area 132.

Further, it is desired to determine if the object 130 is from within the work area 102 or if the object 130 has moved into the work area 102 after the commencement of the digging operation. For example, if the object 130 moves to the work area 102 after the commencement of the digging operation, the digging operation may have to be stopped for removal of the object 130 from the work area 102. Accordingly, the present disclosure relates to a system 122 (shown in FIG. 2) for monitoring the work area 102. The system 122 determines if the object 130 belongs to the work area 102 or if the object 130 has moved into the work area 102 after the commencement of the digging operation.

Figure 2:
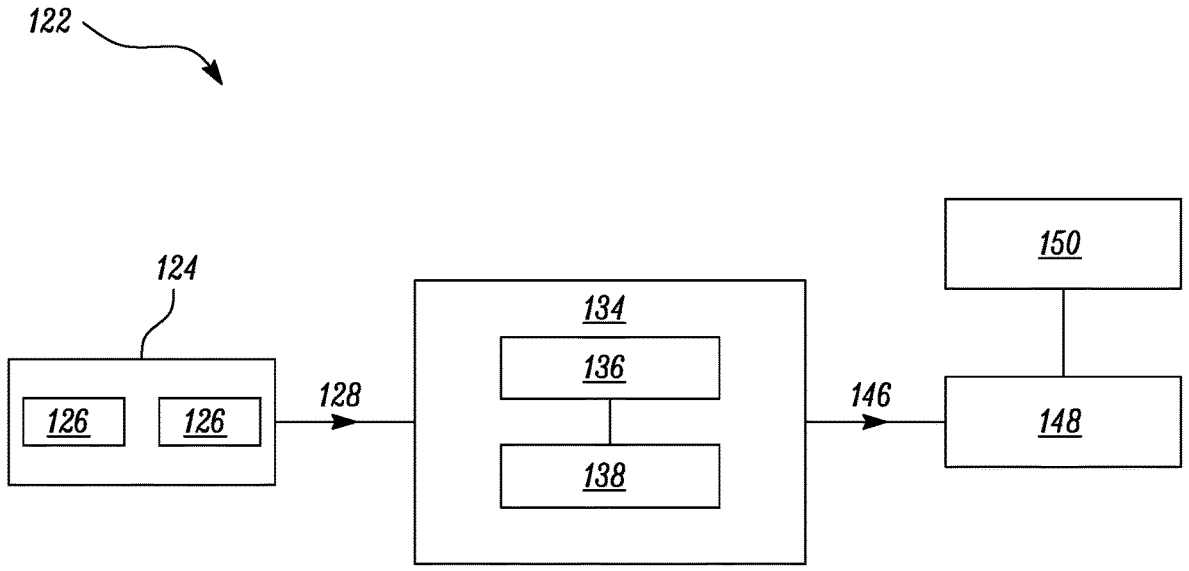
FIG. 2 is a block diagram of a system for monitoring the work area of the work machine shown in FIG. 1, according to an embodiment of the present disclosure.

FIG. 2 illustrates a block diagram of the system 122 for monitoring the work area 102 of the work machine 104 shown in FIG. 1, according to an example of the present disclosure. The system 122 includes a sensor system 124. The sensor system 124 is mounted on the work machine 104 and/or the worksite 100 (see FIG. 1) at which the work machine 104 is operating.

The sensor system 124 generates one or more input signals 128 corresponding to a position of the one or more objects 130 (see FIG. 1) present at the work area 102 and/or the predetermined area 132 surrounding the work area 102. The one or more input signals 128 are indicative of the position of the object 130 at different instances of time. For example, the sensor system 124 may generate a first input signal at a first instance of time, a second input signal at a second instance of time, and so on. It should be noted that the first input signal may correspond to the second input signal if the object 130 has not moved.

Further, the sensor system 124 includes a number of sensing devices 126. Particularly, the sensor system 124 includes one or more of an imaging device, a laser imaging, detection, and ranging (LIDAR) sensor, a radio detection and ranging (RADAR) sensor, an infrared sensor, a global positioning system (GPS) sensor, and an ultrasonic sensor. In some examples, the number of sensing devices 126 may be mounted on the work machine 104 or the worksite 100. In other examples, the number of sensing devices 126 may be mounted on the work machine 104 as well as the worksite 100, so that the sensing devices 126 together cover a 360 degrees view of the work area 102 and/or the predetermined area 132.

The number of sensing devices 126 generate the one or more input signals 128 indicative of the position of the object 130. Further, in one example, each input signal 128 may include a co-ordinate of the object 130 at the work area 102 and/or the predetermined area 132. The co-ordinates may be received from the GPS sensor. However, the input signals 128 may include any other parameter that may allow tracking of the object 130 at the work area 102 and/or the predetermined area 132.

The system 122 also includes a controller 134 communicably coupled to the sensor system 124. In an application, the controller 134 may be a control circuit, a computer, a microprocessor, a microcomputer, a central processing unit, or any suitable device or apparatus. In some cases, the controller 134 may include one or more of a digital circuit designed to process information, an analog circuit designed to process information, and/or other mechanisms for electronically processing information.

The controller 134 includes one or more memories 136 and one or more processors 138 communicably coupled with the one or more memories 136. In some examples, the one or more memories 136 may include a random access memory (RAM) such as a synchronous dynamic random access memory (SDRAM), read-only memory (ROM), a non-volatile random access memory (NVRAM), an electrically erasable programmable read-only memory (EEPROM), a flash memory, a magnetic or optical data storage media, and the like that can be used to store desired program codes in the form of instructions or data structures and that can be accessed by the processors 138. In some examples, the processors 138 may embody digital processors or analog processors.

With reference to FIGS. 1 and 2, the processors 138 receive the input signals 128 indicative of the position of the object 130 at different instances of time. In some examples, the processors 138 may start receiving the input signals 128 as soon as the work machine 104 starts operating. Further, the processors 138 determine a moving route 140 of the object 130 based on the receipt of the input signals 128. The moving route 140 includes a start point 142 and an end point 144. In the illustrated example of FIG. 1, the start point 142 is a position of the object 130 at the predetermined area 132 at a time T1 and the end point 144 is a position of the object 130 at the work area 102 at a time T2. It should be noted that the processors 138 may determine the moving routes of each object present at the work area 102 and the predetermined area 132.

In order to determine the moving route 140, the processors 138 analyze the input signals 128 received from the number of sensing devices 126. Further, the processors 138 may determine if the input signals 128 received from two or more sensing devices 126 correspond to the same object 130 to determine the moving route 140 of the object 130. In some examples, the processors 138 determine the moving route 140 of the object 130 based on one or more of feature tracking, a distance of the object 130 relative to the sensor system 124, and a location of the object 130 relative to the sensor system 124. More particularly, in one example, the processors 138 may determine if the input signals 128 received from two or more sensing devices 126 correspond to the same object 130 to determine the moving route 140 based on the feature tracking. For example, the processors 138 may determine if objects present in a view of different sensing devices 126 have a same circular feature, a same triangular feature, a same rectangular feature, and the like to determine in the input signals 128 received from two or more sensing devices 126 correspond to the same object 130.

In another example, the processors 138 may determine if the input signals 128 received from two or more sensing devices 126 correspond to the same object 130 to determine the moving route 140 based on the distance and/or the location of the object 130. For example, the processors 138 may use rules, such as, distance/location proximation to determine if the input signals 128 received from two or more sensing devices 126 correspond to the same object 130. This step may be directly achieved by geometry transformation based on mounting angles and locations of the sensing devices 126.

Further, the processors 138 generate a response signal 146 if the start point 142 of the object 130 is located at the predetermined area 132 and the end point 144 of the object 130 is located at the work area 102. In some examples, the processors 138 track the movement of the object 130 from the predetermined area 132 into the work area 102 to generate the response signal 146. In one example, the response signal 146 is a control signal to halt the earthmoving operation by the work machine 104. In some examples, the response signal 146 may be directly transmitted to the front work unit 106 to halt the digging operation. In other examples, the system 122 may be communicably coupled to a machine control unit (MCU). In such an example, the response signal 146 may be transmitted to the MCU, so that the MCU may in turn transmit control signals to the front work unit 106 to halt the digging operation.

In another example, the response signal 146 is an alert notification displayed on a display device 148 present in the operator cabin 116 of the work machine 104 and/or a remotely located back-office 150. The display device 148 may include a user interface that may be present in the operator cabin 116 or the back-office 150. In an example, when the work machine 104 is embodied as a semi-autonomous machine, the alert notification may be displayed on the display device 148 present in the operator cabin 116 so that the operator may take corrective actions, such as, halting of the earthmoving operation if the object 130 has moved from outside of the work area 102. Further, when the work machine 104 is embodied as an autonomous machine, the alert notification may be displayed on the display device 148 present in the back-office 150 so that a personnel may take corrective actions, such as, halting of the earthmoving operation. In the example illustrated in FIG. 2, the display device 148 is positioned at the back-office 150. Further, the alert notification may include a visual notification, such as, a text message or one or more icons presented on the display device 148. In another example, the alert notification may be an audible notification, such as, a buzzer or an audible message. The alert notification may also include flashing of lights, or any other mode of notifying operators/personnel regarding the presence of the object 130.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The system 122 for monitoring the work area 102 of the work machine 104 as described herein includes the sensor system 124. The sensor system 124 determines if one or more objects, such as, the object 130 is from within the work area 102 or the object has entered the work area 102 from the predetermined area 132. The system 122 uses motion detection and tracking techniques to determine the moving route 140 of the object 130. If the system 122 determines that the object 130 has moved into the work area 102 from the predetermined area 132, the system 122 generates the response signal 146 to indicate that the object 130 is not from the work area 102. The response signal 146 may include the control signal that may halt the earthmoving operation so that the object 130 may be removed from the work area 102. Alternatively, the response signal 146 may include the alert notification that may alert the operator/personnel regarding the movement of the object 130 into the work area 102. Based on the alert notification, the operator/personnel may take corrective measures, for example, removal of the object 130 from the work area 102.

The system 122 may result in improvement in a detection time of the object 130, as well as increase a confidence and accuracy with which the work area 102 is monitored. The system 122 provides an automated technique of monitoring the work area 102, which may reduce dependence on human efforts. Further, the system 122 provides a cost-effective approach with low response latency. Specifically, the sensing devices 126 that are used for detecting the movement of the object 130 are cost-effective, which may reduce an overall cost associated with the system 122. Further, the system 122 does not require large amounts of computational power as the system 122 eliminates usage of any object classification algorithms to detect a nature/type of the object 130 and simply determines if the object 130 belongs to the work area 102 based on motion detection and tracking of the object 130.

Figure 3:
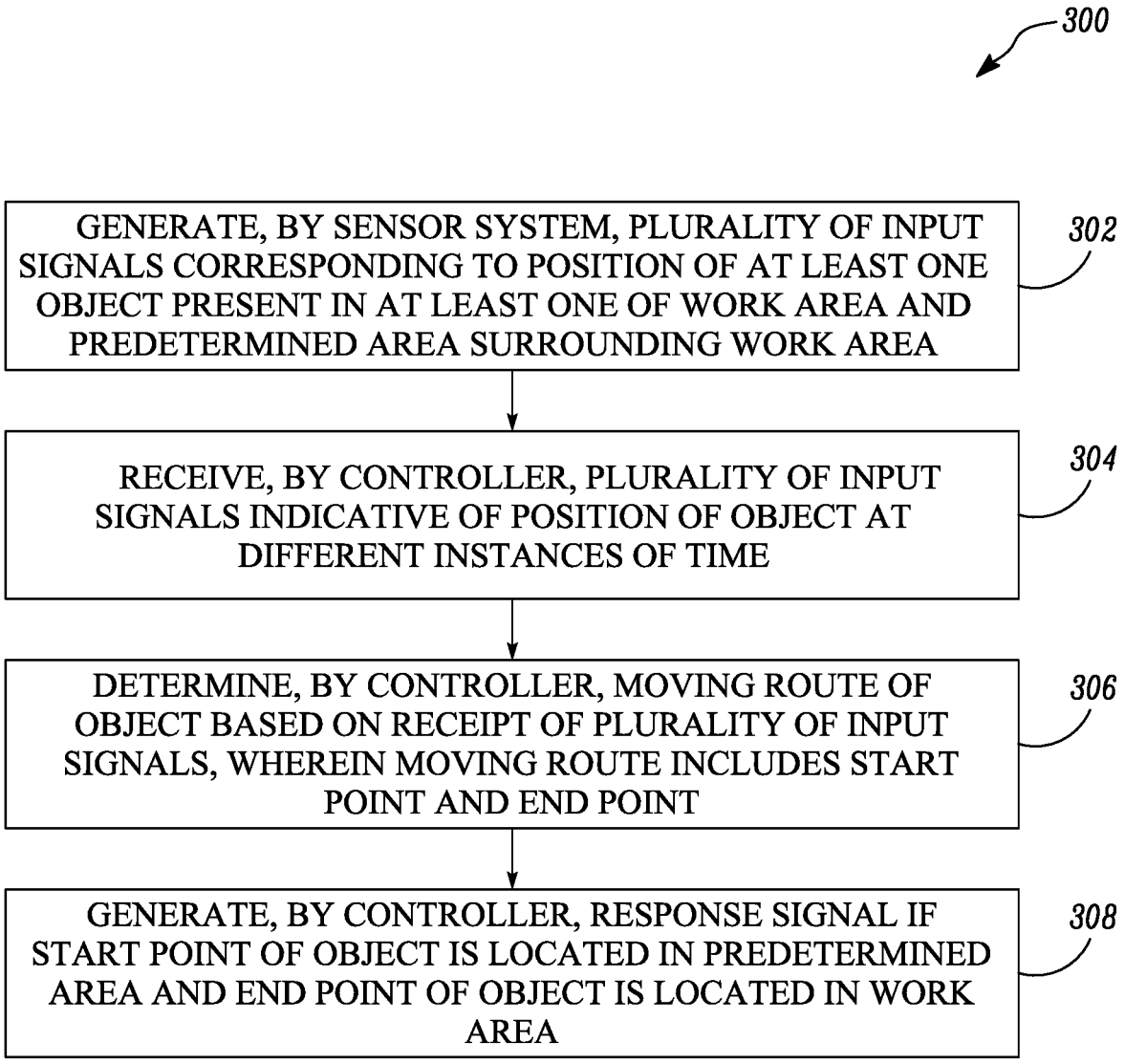
FIG. 3 is a flowchart for a method for monitoring the work area of the work machine, according to an embodiment of the present disclosure.

Referring to FIG. 3, a flowchart for a method 300 for monitoring the work area 102 of the work machine 104 is illustrated. At step 302, the one or more input signals 128 corresponding to the position of the one or more objects 130 present at the work area 102 and/or the predetermined area 132 surrounding the work area 102 are generated by the sensor system 124. The one or more input signals 128 are indicative of the position of the object 130 at different instances of time. The sensor system 124 is mounted on the work machine 104 and/or the worksite 100 at which the work machine 104 is operating. The sensor system 124 includes the number of sensing devices 126. The sensor system 124 includes one or more of the imaging device, the LIDAR sensor, the RADAR sensor, the GPS sensor, the infrared sensor, and the ultrasonic sensor. The number of sensing devices 126 generate the one or more input signals 128 indicative of the position of the object 130. Each input signal 128 includes the co-ordinate of the object 130 in the work area 102 and/or the predetermined area 132.

At step 304, the one or more input signals 128 indicative of the position of the object 130 at different instances of time are received by the controller 134. The controller 134 analyzes the input signals 128 received from two or more of the sensing devices 126. Further, the controller 134 determines if the input signal 128 received from two or more of the sensing devices 126 corresponds to the same object 130.

At step 306, the moving route 140 of the object 130 is determined by the controller 134 based on the receipt of the one or more input signals 128. The moving route 140 includes the start point 142 and the end point 144. The controller 134 determines the moving route 140 of the object 130 based on the feature tracking, the distance of the object 130 relative to the sensor system 124, and/or the location of the object 130 relative to the sensor system 124.

At step 308, the response signal 146 is generated by the controller 134 if the start point 142 of the object 130 is located at the predetermined area 132 and the end point 144 of the object 130 is located at the work area 102. The controller 134 tracks the movement of the object 130 from the predetermined area 132 into the work area 102 to generate the response signal 146. In an example, the response signal 146 is generated to halt the earthmoving operation by the work machine 104. In another example, the response signal 146 is generated to display the alert notification on the display device 148 present in the operator cabin 116 of the work machine 104 and/or the remotely located back-office 150.

While aspects of the present disclosure have been particularly shown and described with reference to the embodiments above, it will be understood by those skilled in the art that various additional embodiments may be contemplated by the modification of the disclosed machine, systems and methods without departing from the spirit and scope of the disclosure. Such embodiments should be understood to fall within the scope of the present disclosure as determined based upon the claims and any equivalents thereof.

What is claimed is:

1. A system for monitoring a work area of a work machine, the system comprising:

a sensor system configured to generate a plurality of input signals corresponding to a position of at least one object present in at least one of the work area and a predetermined area surrounding the work area, wherein the plurality of input signals are indicative of the position of the object at different instances of time; and a controller communicably coupled to the sensor system, wherein the controller includes one or more memories and one or more processors communicably coupled with the one or more memories, and wherein the one or more processors are configured to:

receive the plurality of input signals indicative of the position of the object at different instances of time;

determine a moving route of the object based on the plurality of input signals, wherein the moving route includes a start point and an end point; and generate a response signal if in response to a determination that the start point of the object is located in the predetermined area and the end point of the object is located at the work area; and wherein the response signal comprises at least one of: (i) a first electronic instruction to cause a machine control unit (MCU), communicatively coupled to the controller, to halt operation of the work machine, or (ii) a second electronic instruction to cause a display device to display an alert notification.

2. The system of claim 1, wherein the sensor system includes a plurality of sensing devices, the plurality of sensing devices being configured to generate one or more input signals indicative of the position of the object.

3. The system of claim 2, wherein the one or more processors are further configured to:

analyze the input signal received from two or more of the plurality of sensing devices; and determine if the input signal received from two or more of the plurality of sensing devices corresponds to a same object to determine the moving route of the object.

4. The system of claim 1, wherein the one or more processors are further configured to determine the moving route of the object based on at least one of feature tracking, a distance of the object relative to the sensor system, or a location of the object relative to the sensor system.

5. The system of claim 1, wherein each input signal includes a co-ordinate of the object in at least one of the work area and the predetermined area.

6. The system of claim 1, wherein the display device is disposed in at least one of an operator cabin of the machine or a remotely located back-office.

7. The system of claim 1, wherein the sensor system includes at least one of an imaging device, a laser imaging, detection, and ranging (LIDAR) sensor, a radio detection and ranging (RADAR) sensor, an infrared sensor, a global positioning system (GPS) sensor, and an ultrasonic sensor.

8. The system of claim 1, wherein the sensor system is mounted on at least one of the work machine and a worksite at which the work machine is operating.

9. The system of claim 1, wherein the one or more processors are further configured to track a movement of the object from the predetermined area into the work area to generate the response signal.

10. A method for monitoring a work area of a work machine, the method comprising:

generating, by a sensor system, a plurality of input signals corresponding to a position of at least one object present in at least one of the work area and a predetermined area surrounding the work area, wherein the plurality of input signals are indicative of the position of the object at different instances of time;

receiving, by a controller, the plurality of input signals indicative of the position of the object at different instances of time;

determining, by the controller, a moving route of the object based on the plurality of input signals, wherein the moving route includes a start point and an end point;

generating, by the controller, a response signal if in response to a determination that the start point of the object is located in the predetermined area and the end point of the object is located at the work area; and based on the response signal, performing at least one of: (i) halting, by a machine control unit (MCU), operation of the work machine, or (ii) displaying, by a display device of the work machine, an alert notification.

11. The method of claim 10, wherein the sensor system includes a plurality of sensing devices, the plurality of sensing devices being configured to generate one or more input signals indicative of the position of the object.

12. The method of claim 11 further comprising:

analyzing, by the controller, the input signal received from two or more of the plurality of sensing devices; and determining, by the controller, if the input signal received from two or more of the plurality of sensing devices corresponds to a same object.

13. The method of claim 10 further comprising determining, by the controller, the moving route of the object based on at least one of feature tracking, a distance of the object relative to the sensor system, and a location of the object relative to the sensor system.

14. The method of claim 10, wherein each input signal includes a co-ordinate of the object in at least one of the work area and the predetermined area.

15. The method of claim 10 wherein the display device is present in at least one of an operator cabin of the machine and a remotely located back-office.

16. The method of claim 10, wherein the sensor system includes at least one of an imaging device, a laser imaging, detection, and ranging (LIDAR) sensor, a radio detection and ranging (RADAR) sensor, an infrared sensor, a global positioning system (GPS) sensor, and an ultrasonic sensor.

17. The method of claim 10, wherein the sensor system is mounted on at least one of the work machine and a worksite at which the work machine is operating.

18. The method of claim 10 further comprising track, by the controller, a movement of the object from the predetermined area into the work area to generate the response signal.

19. One or more non-transitory, computer-readable media having instructions stored thereon that, when executed by one or more processors of a computing system, perform operations for monitoring a work area of a work machine, the operations comprising:

generating, by a sensor system, a plurality of input signals corresponding to a position of at least one object present in at least one of the work area and a predetermined area surrounding the work area, wherein the plurality of input signals are indicative of the position of the object at different instances of time;

receiving, by a controller, the plurality of input signals indicative of the position of the object at different instances of time;

determining, by the controller, a moving route of the object based on the plurality of input signals, wherein the moving route includes a start point and an end point;

generating, by the controller, a response signal in response to a determination that the start point of the object is located in the predetermined area and the end point of the object is located at the work area; and based on the response signal, performing at least one of: (i) causing a machine control unit (MCU) to halt operation of the work machine, or (ii) displaying, by a display device of the work machine, an alert notification.

* * * * *